US011109156B2

(12) United States Patent
Barefoot

(10) Patent No.: US 11,109,156 B2
(45) Date of Patent: Aug. 31, 2021

(54) METHOD AND APPARATUS FOR IMPROVING EFFECTIVE SIGNAL-TO-NOISE RATIO OF ANALOG TO DIGITAL CONVERSION FOR MULTI-BAND DIGITAL SIGNAL PROCESSING DEVICES

(71) Applicant: BAREFOOT SOUND, LLC, Los Angeles, CA (US)

(72) Inventor: Thomas Barefoot, Portland, OR (US)

(73) Assignee: Barefoot Sound, LLC, Portland, OR (US)

( * ) Notice: Subject to any disclaimer, the term of this patent is extended or adjusted under 35 U.S.C. 154(b) by 0 days.

(21) Appl. No.: 16/520,713

(22) Filed: Jul. 24, 2019

(65) Prior Publication Data

US 2021/0029449 A1 Jan. 28, 2021

(51) Int. Cl.

| | |
|---|---|
| ***H04R 3/04*** | (2006.01) |
| ***H04R 3/00*** | (2006.01) |
| ***H04R 1/22*** | (2006.01) |

(52) U.S. Cl.

CPC ..... *H04R 3/04* (2013.01); *H04R 1/222* (2013.01); *H04R 3/005* (2013.01)

(58) Field of Classification Search

CPC . H04R 3/14; H04R 3/04; H04R 1/222; H04R 3/005

USPC ..... 381/99, 100

See application file for complete search history.

(56) References Cited

U.S. PATENT DOCUMENTS

| | | | | |
|---|---|---|---|---|
| 5,794,187 | A | 8/1998 | Franklin et al. | |
| 2003/0021428 | A1 | 1/2003 | Abe et al. | |
| 2006/0005694 | A1 * | 1/2006 | Waller, Jr. ..... | G10H 1/12 84/736 |
| 2011/0087346 | A1 | 4/2011 | Larsen et al. | |
| 2011/0267214 | A1 | 11/2011 | Roach | |

(Continued)

OTHER PUBLICATIONS

Almeroth et al., "Analyzing the signal-to-noise ratio of direct sampling receivers.", 2013 IEEE Int'l Conference on Communications (ICC), Jun. 13, 2013, Retrieved on Sep. 13, 2020 (Sep. 13, 2020) from <http://citeseerx.ist.psu.edu/viewdoc/download?doi=10.1.1.925.8806&rep=rep1&type=pdf>.

(Continued)

*Primary Examiner* — David L Ton

(74) *Attorney, Agent, or Firm* — Munck Wilson Mandala

(57) ABSTRACT

A method for improving the effective signal-to-noise ratio ("SNR") of an analog to digital converter ("ADC") for active loudspeakers uses the two available channels of a stereo ADC to separately process the low- and high-frequency components of an audio signal. Because the power spectral density of music approximates a pink noise spectrum, the high-frequency component of the signal has peak levels low enough to avoid exceeding the maximum ADC input level. The audio signal is analog high-pass filtered and the resulting high-frequency signal component is sent directly to a first ADC channel without attenuation. The remaining low-frequency component is attenuated and sent to a second ADC channel. The digital signals are processed, converted back to analog, amplified, and reproduced by loudspeaker drivers. Noise and distortion at low frequencies is less audible than higher frequencies, so the improved SNR at higher frequencies yields a significant practical improvement in audio fidelity.

19 Claims, 3 Drawing Sheets

(56) References Cited

U.S. PATENT DOCUMENTS

| | | | | |
|---|---|---|---|---|
| 2013/0163770 | A1* | 6/2013 | Takemura | H04R 3/14<br>381/59 |
| 2014/0172421 | A1 | 6/2014 | Liu et al. | |

OTHER PUBLICATIONS

U.S. International Searching Authority, International Search Report and Written Opinion of the International Searching Authority, Int'l App. No. PCT/US2020/043023, dated Sep. 28, 2020.

* cited by examiner

METHOD AND APPARATUS FOR IMPROVING EFFECTIVE SIGNAL-TO-NOISE RATIO OF ANALOG TO DIGITAL CONVERSION FOR MULTI-BAND DIGITAL SIGNAL PROCESSING DEVICES

BACKGROUND OF THE INVENTION

(1) Field of the Invention

The present invention relates generally to analog to digital signal conversion devices and methods, and more particularly to methods for improving the effective signal-to-noise ratio of analog to digital conversion for active loudspeakers and other multi-band digital signal processing devices by using the two channels of a stereo analog to digital converter device to separately process the low- and high-frequency components, respectively, of an analog input signal, as well as an active loudspeaker apparatus employing those methods.

(2) Description of the Related Art

Active loudspeakers are loudspeakers that are combined with one or more amplifiers in a single unit, such that a separate audio amplifier is not required for line-level audio input signals. Typically, an active loudspeaker includes a crossover filter ("crossover") to separate the audio signal into two or more frequency bands (e.g., high- and low-frequency components in a two-way active speaker, or high-, medium- and low-frequency components in a three-way active speaker) for reproduction with separate speaker drivers (e.g., a tweeter for the high-frequency component and a woofer for the low-frequency component). The crossover can be applied to the audio signal after amplification ("passive crossover") or before amplification ("active crossover"). Active speakers that use a passive crossover require only a single amplifier, whereas active speakers that use an active crossover require a separate amplifier for each frequency band (i.e., two amplifiers in a two-way active speaker).

The crossover can be implemented in either analog or digital circuitry. High-end active loudspeakers typically implement an active crossover using digital signal processor ("DSP") circuitry. Using a DSP allows the processing of an analog audio input signal without the losses, signal degradation, and additional component costs introduced by analog signal processing circuitry. By performing the crossover function digitally, greater selectivity and a sharper frequency cutoff can be achieved as compared with analog filters. A DSP also allows additional functionality to be easily and inexpensively added to the active loudspeaker, including audio effects such as equalization, dynamic range compression, delay, reverberation, modulation, or mixing and playback of multiple simultaneous signal inputs, without adding additional circuitry.

FIG. 1 shows a schematic diagram of an example prior art a two-way active loudspeaker 101 that implements a crossover using a DSP. Prior art active loudspeakers like that shown in FIG. 1 are typically implemented as a chain of electronic components that include an analog audio input stage 102, an analog attenuation stage 103, a stereo analog to digital converter ("ADC") 104, a DSP 105, a stereo digital to analog converter ("DAC") 106, an analog signal booster stage 107, one or more power amplifiers 108, and one or more loudspeaker drivers 109. Two or more of these components may be combined in a single integrated circuit chip (e.g., the ADC and DAC may be included with additional DSP circuitry in a single chip).

The maximum peak-to-peak signal levels for line-level inputs and outputs in professional audio equipment are typically on the order of 12 volts or more while the maximum peak-to-peak input and output line levels for most commonly available audio ADC and DAC devices are in the range of 2 volts and are limited by the standard supply voltages of 5 volts or 3.3 volts typically used in digital circuity. Thus, analog attenuation stage 103 is necessary to accommodate the limited peak-to-peak input range of ADC 104 when it is connected to a professional audio equipment source via analog audio input 102. The required attenuation is typically 15 dB (i.e., −15 dB gain). Similarly, the analog signal booster stage 107 amplifies the output of DAC 106 approximately +15 dB to match the professional audio equipment signal level of 12 volts required by loudspeaker power amplifiers 108.

Discrete-packaged ADC devices commonly have two audio channels to allow a single device to be used for digitizing a stereo audio signal. However, individual loudspeakers typically have monaural signal inputs (e.g., either the left or right channel of a stereo signal), and so only require a single ADC channel. Given that the second ADC channel is present inside a monaural active loudspeaker, it is desirable not to leave the it unused (and thus "wasted"). Therefore, the second channel is often used in an attempt to improve the signal-to-noise ratio ("SNR") in prior art active loudspeakers. This is accomplished by inverting the polarity of the attenuated input signal from attenuation stage 103 that is fed to ADC channel 111 as compared with the polarity fed to ADC channel 110. The outputs of the two ADC channels are subtracted 112 from one another by program instructions running on DSP 105. This method can theoretically reduce uncorrelated noise in the ADC inputs by 3 dB. In practice, however, there is not much uncorrelated noise in the ADC inputs because both ADC channel circuits are typically laid out closely together on a single silicon chip, and are thus affected almost equally by external sources of noise. Therefore, the noise reduction achieved with this method is usually much lower than 3 dB.

The difference signal from the two ADC channels is fed along path 113 to high-pass filter stages 114 and along path 115 to low-pass filter stages 116 of DSP 105. High- and low-pass filter stages 114 and 116 form a crossover filter inside DSP 105 that separates the input signal into high- and low-frequency components. FIG. 1 shows a typical example of two cascaded second-order filters in each of high- and low-frequency filter stages 114 and 116. After processing, each of the filtered high- and low-frequency components is converted back to a separate analog signal via stereo DAC 106. The separated high- and low-frequency analog signal components are then boosted by analog signal booster stage 107 to restore the 12-volt audio signal level, and sent to power amplifiers 108 that drive the high- and low-frequency loudspeaker transducers 109.

The limited peak-to-peak input and output signal ranges of commonly available ADC and DAC devices present significant disadvantages with respect to the signal-to-noise ratio. Pre-ADC attenuation stage 103 and post-DAC gain stage 107 each introduce noise into the audio signal. This noise limits the published SNR specifications for ADC 104 and DAC 106. Furthermore, signal attenuation inherently reduces the effective audio resolution and ultimately the fidelity of the loudspeaker. For example, if ADC 104 has a resolution of 24 bits and attenuation stage 103 reduces the input signal level by 15 dB, the input signal resolution has effectively been reduced by 5 bits relative to the unattenuated input signal $$\left(\text{because } \log_2\left[10^{\frac{15\,dB}{10\,dB}}\right] \approx 5 \text{ bits}\right),$$

so the input signal resolution of 24-bit ADC 104 is effectively only 19 bits. This reduces the headroom available for signal processing in DSP 105 and can result in an audible reduction in sound quality.

Thus, there is a need for analog-to-digital signal conversion without reduction in input signal resolution, thereby improving the effective signal-to-noise ratio in active loudspeakers and other devices.

BRIEF SUMMARY OF THE INVENTION

A method for improving the effective signal-to-noise ratio of analog to digital and digital to analog conversion for active loudspeakers and other multi-band digital signal processing devices is presented. In one or more embodiments, the method of the present invention uses the two available channels of a stereo analog to digital converter device to separately process the low- and high-frequency components of the signal.

The power spectral density of music approximates that of a pink noise (also known as 1/f noise) spectrum, i.e., one where the power density of the signal is inversely proportional to the frequency. Thus, for pink noise as well as for typical music, the power density for signal frequencies above the middle of the audio spectrum (i.e., around 600 Hz and higher) is approximately 15 dB lower than the power density for signal frequencies around 20 Hz. Therefore, the higher-frequency component of the audio signal (i.e., the audio frequencies above approximately 600 Hz) does not need to be attenuated by 15 dB before entering the ADC stage, because that higher-frequency component already has a peak signal level at least 15 dB lower than the peak signal level at 20 Hz.

In one or more embodiments, an active loudspeaker with digital signal processing circuitry exploits this property of the 1/f power density spectrum to improve the effective signal-to-noise ratio. In one or more embodiments, a high-frequency component of the audio signal is separated from the audio signal prior to any attenuation or analog to digital conversion. The high-frequency component is formed by high-pass filtering the unattenuated input signal in the analog domain by an analog high-pass filter stage. The resulting high-frequency component is then sent to one channel of the ADC without any attenuation, thereby increasing the effective SNR of the high-frequency component by 15 dB, or 5 bits of resolution.

In one or more embodiments, the original audio signal (containing both high-frequency and low-frequency components) is attenuated by 15 dB in an analog attenuation stage to produce an attenuated audio signal, then sent to the other channel of the ADC. The attenuated audio signal is processed and digital low-pass filtered in the DSP to produce a low-frequency component of the audio signal. The high-frequency component is separately processed and filtered in the DSP. Both the high- and low-frequency components are then converted back to analog signals by a DAC. The low-frequency component is boosted by an analog signal booster stage to bring it back to the pre-attenuation level, and both signal components are then amplified by separate power amplifiers and reproduced audibly by separate loudspeaker drivers.

Because human hearing is less sensitive to noise and distortion at low frequencies than at midrange and high frequencies, the improved SNR and effective bit depth in the midrange and high frequencies yields a significant practical improvement in overall loudspeaker performance and audio fidelity.

BRIEF DESCRIPTION OF THE DRAWINGS

The present invention may be better understood, and its features made apparent to those skilled in the art by referencing the accompanying drawings.

The use of the same reference symbols in different drawings indicates similar or identical items.

DETAILED DESCRIPTION OF THE INVENTION

A method for improving the effective signal-to-noise ratio of analog to digital and digital to analog conversion for active loudspeakers and other multi-band digital signal processing devices is presented. In one or more embodiments, the method of the present invention uses the two available channels of a stereo analog to digital converter device to separately process the low- and high-frequency components of the signal.

The power spectral density of music approximates that of a pink noise (also known as 1/f noise) spectrum, i.e., one where the power density of the signal is inversely proportional to the frequency. Thus, for pink noise as well as for typical music, the peak signal power (and therefore peak signal level) at a particular frequency drops by 3 dB for every doubling of frequency, equivalent to a 30 dB difference between peak signal levels across the range of the audible spectrum from 20 Hz to 20 kHz.

Figure 2:
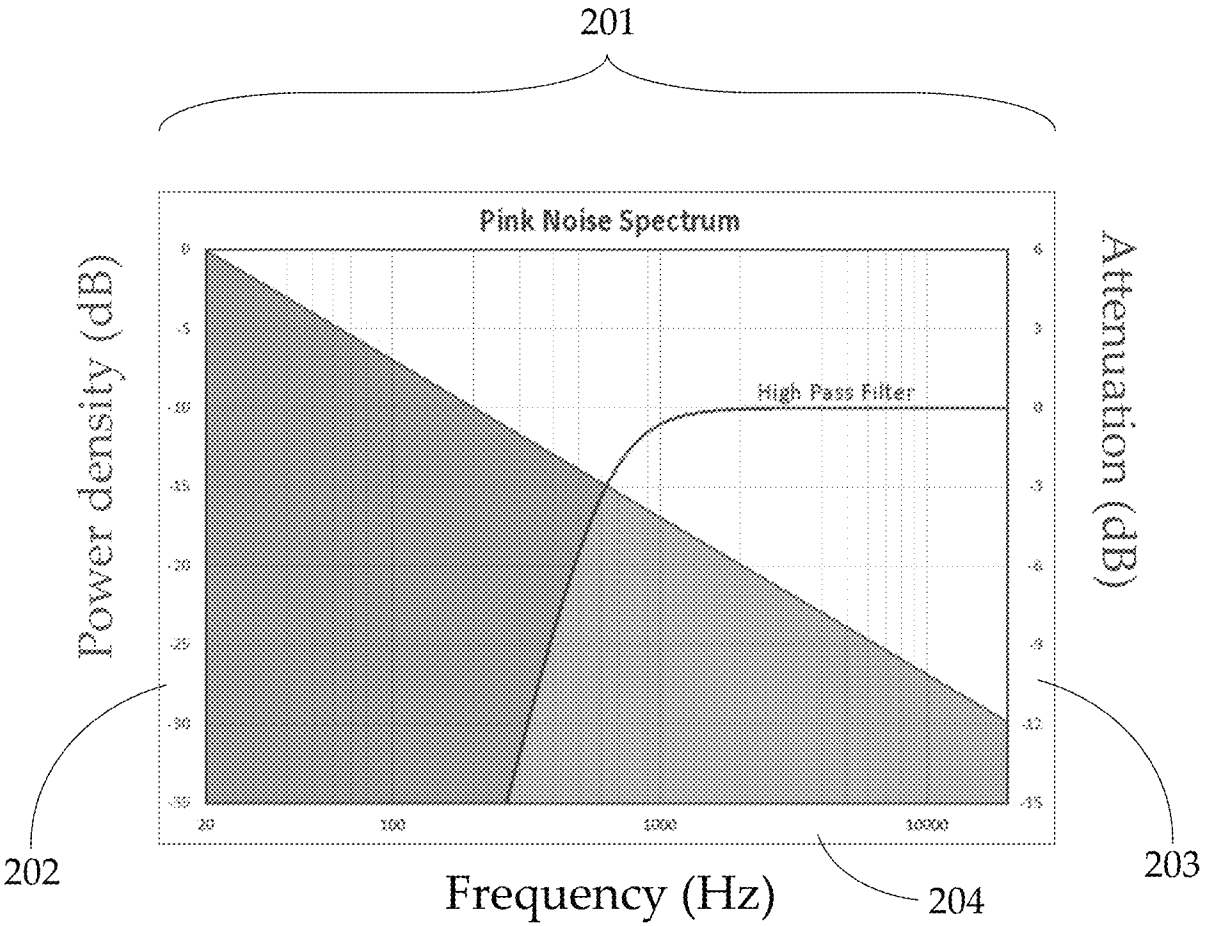
FIG. 2 is a graph showing the power density versus frequency of a pink noise spectrum, as well as the attenuation versus frequency of a high-pass filter used in an embodiment of the present invention.

FIG. 2 is a graph 201 showing the power density versus frequency of a pink noise spectrum, as well as the attenuation versus frequency of a high-pass filter used in an embodiment of the present invention. The left vertical scale 202, right vertical scale 203, and horizontal scale 204 of graph 201 are all logarithmic. Left vertical scale 202 represents the power density in dB at a particular frequency, with the zero dB level normalized to the maximum power level of the entire signal. Right vertical scale 203 represents the signal attenuation in dB at a particular frequency of a high-pass filter having a cutoff frequency of approximately 600 Hz as used in an embodiment of the present invention.

FIG. 2 shows that the power density for signal frequencies above the middle of the audio spectrum (i.e., around 600 Hz and higher) is approximately 15 dB lower than the power density for signal frequencies around 20 Hz. This is because the power density at a given frequency, represented by $P_f$, is proportional to 1/f, so the difference in power density between 600 Hz and 20 Hz is:

$$P_{600\,Hz} - P_{20\,Hz} = 10\log_{10}\frac{P_{600\,Hz}}{P_{20\,Hz}} = 10\log_{10}\frac{20\text{ Hz}}{600\text{ Hz}} \approx -14.8\text{ dB}.$$

Therefore, the higher-frequency component of the audio signal (i.e., the audio frequencies above approximately 600 Hz) does not need to be attenuated by 15 dB before entering the ADC stage, because that higher-frequency component already has a peak signal level at least 15 dB lower than the peak signal level at 20 Hz.

Figure 3:
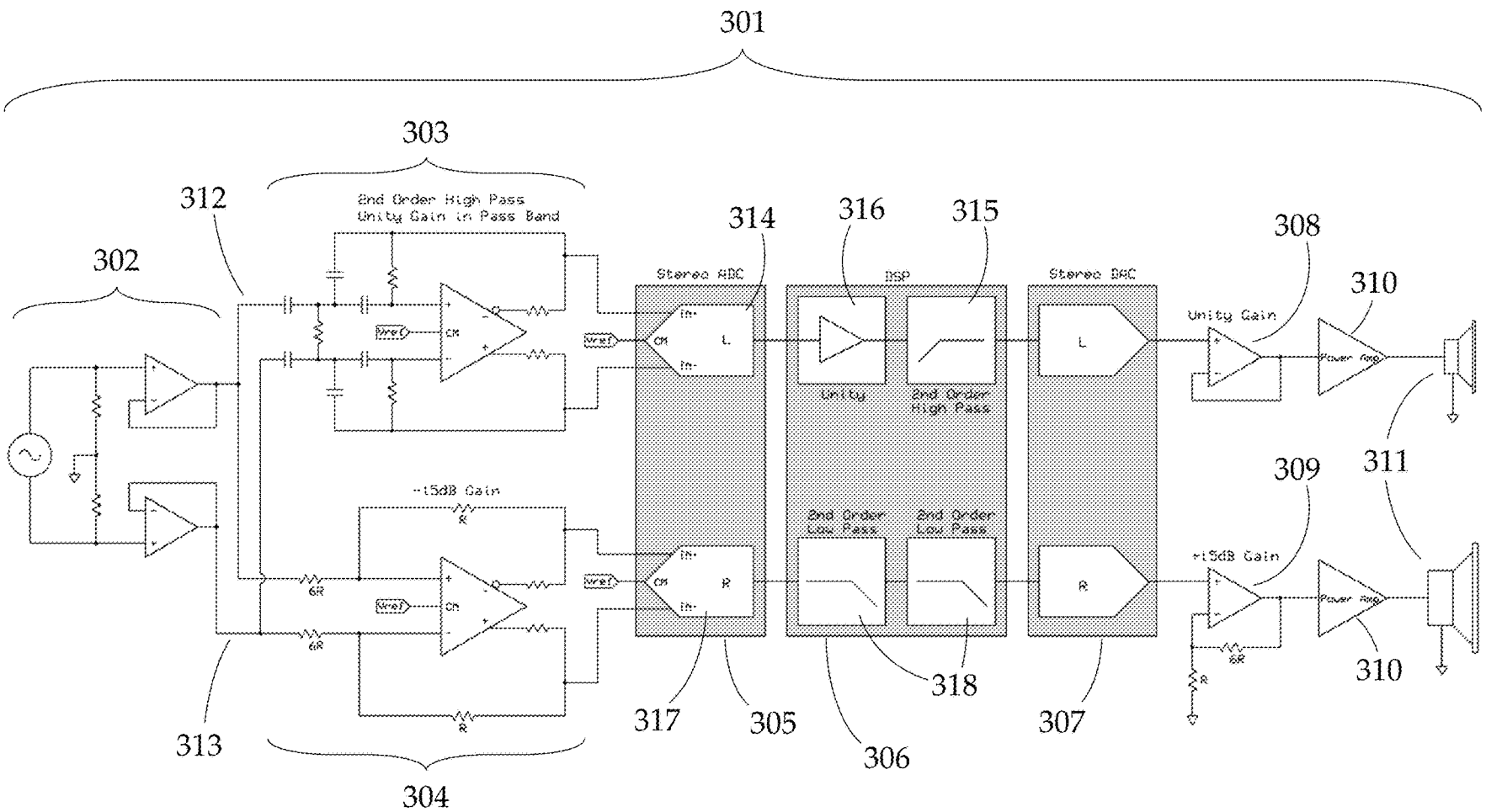
FIG. 3 is a schematic diagram of a two-way active loudspeaker with digital signal processing circuitry having an improved effective signal-to-noise ratio, which is an embodiment of the present invention.

FIG. 3 is a schematic diagram of a two-way active loudspeaker with digital signal processing circuitry that exploits this property of the 1/f power density spectrum to improve the effective signal-to-noise ratio, which is an embodiment of the present invention. In the embodiment of FIG. 3, active loudspeaker 301 includes analog audio input stage 302, analog high-pass filter stage 303, analog attenuation stage 304, stereo analog to digital converter ("ADC") 305, DSP 306, stereo digital to analog converter ("DAC") 307, analog unity gain stage 308, analog signal booster stage 309, power amplifiers 310, and loudspeaker drivers 311.

In the embodiment of FIG. 3, the audio input signal is fed to high-pass filter stage 303 along path 312 and separately to analog attenuation stage 304 along path 313 prior to any attenuation or analog to digital conversion. The input signal fed to high-pass filter stage 303 along path 312 is high-pass filtered in the analog domain by analog high-pass filter stage 303, then sent to first ADC channel 314 of ADC 305 to produce an unattenuated digital high-frequency component of the signal.

In the embodiment of FIG. 3, analog high-pass filter stage 303 is an active second-order high-pass filter having unity gain that includes an operational amplifier and a resistive-capacitive network, with electronic component values chosen to place the cutoff frequency at approximately 600 Hz. In one or more alternative embodiments, analog high-pass filter stage 303 may have a gain of greater or less than unity. For example, analog high-pass filter stage 303 may attenuate the signal by a small amount, but by much less than the 15 dB of attenuation applied by analog attenuation stage 304. Alternatively, in one or more embodiments, analog high-pass filter stage 303 may be a passive high-pass filter or any other type of audio frequency filter. In one or more embodiments, the high-pass cutoff frequency required to avoid exceeding the input signal level limits of ADC 305 without signal attenuation is typically a value between 400-800 Hz, but analog high-pass filter stage 303 may have a higher or lower cutoff frequency as required to avoid exceeding the input limits of ADC 305.

Figure 1:
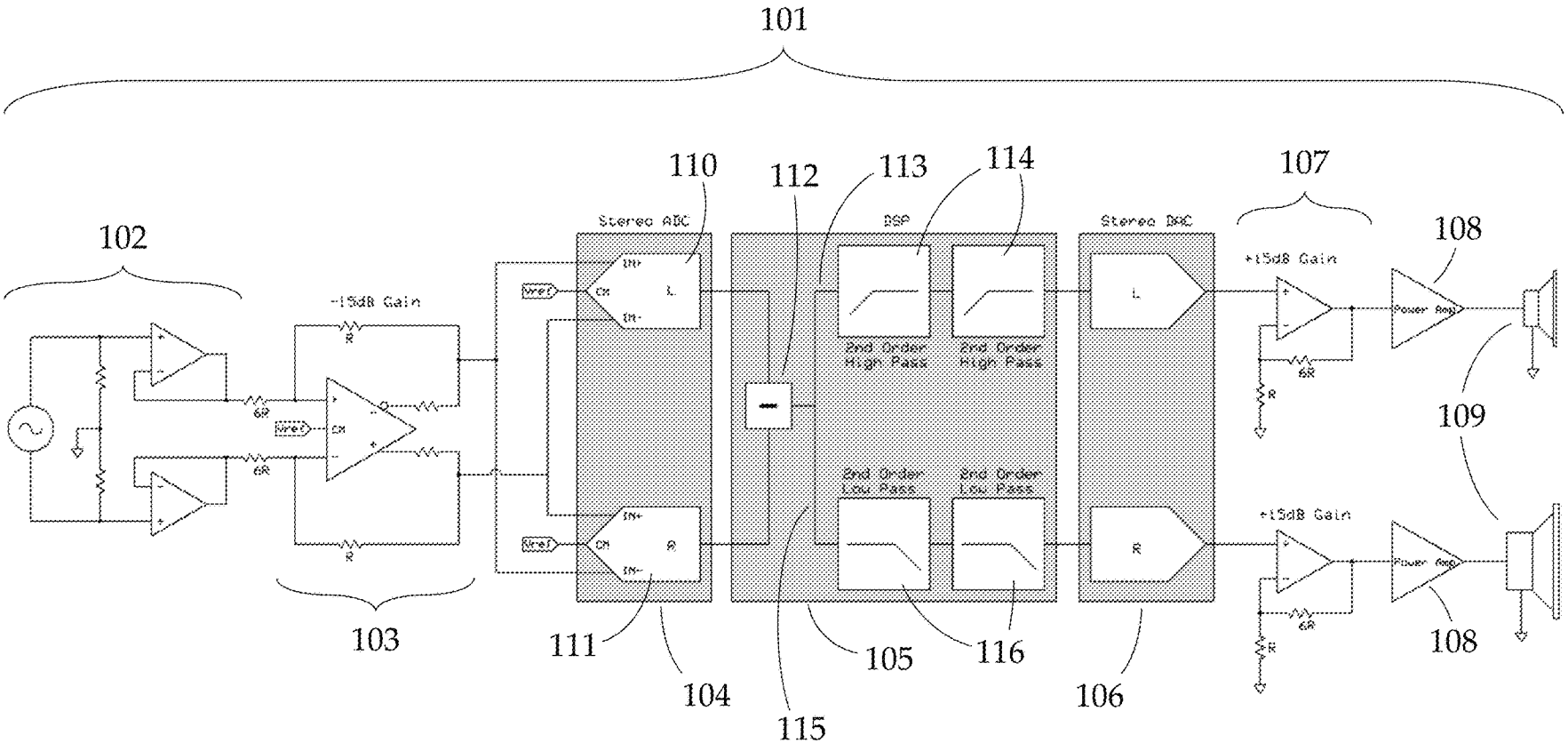
FIG. 1 is a schematic diagram of a prior art a two-way active loudspeaker with digital signal processing circuitry.

In the embodiment of FIG. 3, analog high-pass filter stage 303 performs a similar function to that of one of the second-order high-pass filters 114 shown in FIG. 1. For that reason, only one digital second-order high-pass filter 315 is included in DSP 306, with a unity filter stage 316 substituted for one of the second-order high-pass filters 114 shown in FIG. 1. In one or more alternative embodiments, unity filter stage 316 may be omitted, or additional or substitute first-order, second-order, or higher-order high-pass filter stages may be included in either or both of analog high-pass filter stage 303 or DSP 306 as required to achieve the desired crossover filtering function.

In the embodiment of FIG. 3, the digital high-frequency component that is output from high-pass filter 315 is then converted back to an analog high-frequency signal component in a first channel of DAC 307. The analog high-frequency component is then passed through analog unity gain stage 308, is amplified by a first power amplifier 310, and is reproduced audibly by a first loudspeaker driver 311 (i.e., a tweeter). In one or more alternative embodiments, analog unity gain stage 308 may be omitted so that the output of the first channel of DAC 307 is routed directly to power amplifier 310.

In one or more embodiments, the lack of attenuation of the high-frequency audio signal component allows DSP 306 to process that high-frequency component with a higher effective bit resolution. Furthermore, the high-frequency signal component does not need to be boosted after DAC 307, thereby avoiding the introduction of additional noise and distortion to the high-frequency component of the audio signal. In the embodiment of FIG. 3, the effective SNR of the high-frequency component is increased by 15 dB, or 5 bits of resolution.

As demonstrated by FIG. 2, the low-frequency component of the audio signal must be attenuated so that the larger peak signal amplitude does not exceed the input range of ADC 305. In the embodiment of FIG. 3, the audio input signal that does not pass through analog high-pass filter 303 is attenuated by 15 dB in analog attenuation stage 304, then sent to second ADC channel 317 of ADC 305. In the embodiment of FIG. 3, the attenuated audio signal then passes through digital second-order low-pass filters 318 in DSP 306 to produce a digital low-frequency component. In one or more embodiments, additional or substitute first-order, second-order, or higher-order low-pass filter stages may be included in DSP 306 as required to achieve the desired crossover filtering function.

In the embodiment of FIG. 3, the digital high-frequency component that is output from low-pass filters 318 is then converted back to an analog low-frequency signal component in a second channel of DAC 307. The analog low-frequency signal component is then boosted by analog signal booster stage 309, is amplified by a second power amplifier 310, and is reproduced audibly by a second loudspeaker driver 311 (i.e., a woofer). In one or more embodiments, although analog attenuation stage 304 and analog signal booster stage 309 introduce some additional noise and distortion to the low-frequency component of the audio signal, the noise and distortion is less audible than it would be for higher frequency audio content because human hearing is less sensitive to noise and distortion at low frequencies than at midrange and high frequencies. Thus, in the embodiment of FIG. 3, the improved SNR and effective bit depth in the midrange and high frequencies yields a significant practical improvement in overall loudspeaker performance and audio fidelity.

In one or more embodiments, the audio signal may be split into more than two components. For example, in a three-way loudspeaker, the audio signal is split into low-, midrange-, and high-frequency components. In one or more embodiments, the low-frequency component is attenuated, digitized, digital low-pass filtered, converted back to analog, amplified, and routed to a woofer speaker driver as described above, but with a lowered low-pass filter cutoff of, for example, 300 Hz. Similarly, the high-frequency component is analog high-pass filtered, digitized, digital high-pass filtered, converted back to analog, amplified, and routed to a tweeter speaker driver as described above, but with a raised high-pass filter cutoff of, for example, 2000 Hz.

Since the midrange frequencies require less attenuation than low frequencies, the midrange-frequency component may be analog band-pass filtered and attenuated by a smaller amount than the low-frequency component before entering the ADC. For example, in one or more embodiments, the analog midrange band-pass filter has a lower cutoff of 300 Hz and an upper cutoff of 2000 Hz, and the midrange frequency attenuation is only 3 dB. This is because the difference in power density between 300 Hz and 20 Hz is:

$$P_{300\,Hz} - P_{20\,Hz} = 10\log_{10}\frac{P_{300\,Hz}}{P_{20\,Hz}} = 10\log_{10}\frac{20\text{ Hz}}{300\text{ Hz}} \approx -11.7\text{ dB},$$

thus requiring only approximately 3 dB attenuation to reach a signal level of −15 dB relative to 20 Hz. Alternatively, to reduce complexity and electronic component costs, the midrange-frequency component may only be analog high-pass filtered, for example with a cutoff of 300 Hz, with further band-pass filtering performed digitally within DSP 306. The midrange-frequency component is then digitized, digitally band-pass filtered, converted back to analog, amplified, and routed to a midrange speaker driver. Thus, in one or more embodiments, the SNR and effective bit depth may be optimized for multiple frequency bands, minimizing audible distortion even further than for the two-way speaker example.

In one or more embodiments, the audio signal of path 313 may be analog low-pass filtered before attenuation to eliminate the energy content of the high-frequency component of the signal, thereby slightly reducing the attenuation required in analog attenuation stage 304 and the subsequent boost in analog signal booster stage 309. Although the high-frequency component of the signal adds only a small amount of additional energy to the signal, it is possible to save approximately 2 dB of headroom by filtering it out, thereby reducing the attenuation required and increasing the low-frequency resolution by 0.66 bits. In embodiments that require the highest audio fidelity, this improvement may be worth the added cost and complexity of the additional analog low-pass filters.

In the embodiment of FIG. 3, analog audio input stage 302, analog high-pass filter stage 303, analog attenuation stage 304, and ADC 305 are shown with balanced signal inputs and outputs, which is commonly used in the line-level signal inputs and outputs of professional audio equipment to reduce the effect of external electromagnetic noise on the audio signal. In one or more alternative embodiments, analog audio input stage 302, analog high-pass filter stage 303, analog attenuation stage 304, and/or ADC 305 may instead use unbalanced signal inputs and/or outputs (i.e., a single-ended signal wire and a ground, as is commonly used in consumer-grade audio equipment) for all or part of the pre-DSP signal path. Similarly, in the embodiment of FIG. 3, gain stages 308 and 309 and power amplifiers 310 are shown with unbalanced signal inputs and outputs, but may instead use balanced signal inputs and/or outputs for all or part of the post-DSP signal path in one or more alternative embodiments.

Thus, a method for improving the effective signal-to-noise ratio of analog to digital and digital to analog conversion for active loudspeakers and other multi-band digital signal processing devices by using the two available channels of a stereo analog to digital converter device to separately process the low and high-frequency components of the signal is described. Although the present invention has been described with respect to certain specific embodiments, it will be clear to those skilled in the art that the inventive features of the present invention are applicable to other embodiments as well, all of which are intended to fall within the scope of the present invention. For example, the cutoff frequencies of the low-pass, band-pass, and/or high-pass filters may be adjusted to suit the frequency response range of each speaker driver. Similarly, the amount of pre-ADC attenuation and/or post-DAC boost may be adjusted according to the maximum peak-to-peak input signal level and the maximum allowable signal level for the ADC. Additionally, the method may be used to improve the effective signal-to-noise ratio in any application that uses multi-band digital signal processing, such as audio compressors, audio effects processors, audio and/or video recording devices, sound reinforcement or public address systems, or speech recognition, among others.

What is claimed is:

1. A method for improving the effective signal-to-noise ratio for active loudspeakers, the method comprising the steps of:

receiving an analog audio signal;

high-pass filtering the analog audio signal to produce a first high-frequency analog signal;

converting the first high-frequency analog signal to a high-frequency digital signal;

attenuating the analog audio signal by approximately 15 dB to produce an attenuated analog signal;

converting the attenuated analog signal to an attenuated digital signal;

applying digital signal processing to the high-frequency digital signal and/or the attenuated digital signal;

converting the high-frequency digital signal to a second high-frequency analog signal;

converting the attenuated digital signal to a low-frequency analog signal;

amplifying the second high-frequency analog signal to produce an amplified high-frequency analog signal;

amplifying the low-frequency analog signal to produce an amplified low-frequency analog signal;

reproducing the amplified high-frequency analog signal with a first loudspeaker driver; and reproducing the amplified low-frequency analog signal with a second loudspeaker driver.

2. The method of claim 1 wherein the step of high-pass filtering the analog audio signal comprises selecting a cutoff frequency of approximately 600 Hz.

3. The method of claim 1 wherein the step of high-pass filtering the analog audio signal comprises selecting a cutoff frequency between 400-800 Hz.

4. The method of claim 1 wherein the step of applying digital signal processing comprises applying a digital high-pass filter to the high-frequency digital signal.

5. The method of claim 4 wherein the digital high-pass filter comprises a second-order high-pass filter.

6. The method of claim 1 wherein the step of applying digital signal processing comprises applying a digital low-pass filter to the attenuated digital signal.

7. The method of claim 6 wherein the digital low-pass filter comprises a second-order low-pass filter.

8. The method of claim 6 wherein the digital low-pass filter comprises a plurality of cascaded low-pass filters.

9. The method of claim 1 wherein the step of amplifying the low-frequency analog signal comprises the steps of:

boosting the low-frequency analog signal by approximately 15 dB to produce a boosted low-frequency analog signal; and using a power amplifier to amplify the boosted low-frequency analog signal.

10. An active loudspeaker comprising:

an analog audio input stage;

an analog high-pass filter stage comprising a high-pass filter stage input connected to the analog audio input stage and a high-pass filter stage output;

an analog attenuation stage comprising an attenuation stage input connected to the analog audio input stage and an attenuation stage output;

a stereo analog to digital converter (ADC) comprising a first ADC channel input connected to the high-pass filter stage output, a second ADC channel input connected to the attenuation stage output, a first ADC channel output, and a second ADC channel output;

a digital signal processor (DSP) comprising a first DSP channel input connected to the first ADC channel output, a second DSP channel input connected to the second ADC channel output, a first DSP channel output, and a second DSP channel output;

a stereo digital to analog converter (DAC) comprising a first DAC channel input connected to the first DSP channel output, a second DAC channel input connected to the second DSP channel output, a first DAC channel output, and a second DAC channel output;

a first power amplifier comprising a first power amplifier input connected to the first DAC channel output and a first power amplifier output;

a second power amplifier comprising a second power amplifier input connected to the second DAC channel output and a second power amplifier output;

a first loudspeaker driver connected to the first power amplifier output; and a second loudspeaker driver connected to the second power amplifier output.

11. The active loudspeaker of claim 10 wherein the analog high-pass filter stage further comprises a cutoff frequency of approximately 600 Hz.

12. The active loudspeaker of claim 10 wherein the analog high-pass filter stage further comprises a cutoff frequency between 400-800 Hz.

13. The active loudspeaker of claim 10 wherein the analog attenuation stage provides an attenuation of approximately 15 dB.

14. The active loudspeaker of claim 10 wherein the DSP further comprises a digital high-pass filter connected between the first DSP channel input and the first DSP channel output.

15. The active loudspeaker of claim 14 wherein the digital high-pass filter comprises a second-order high-pass filter.

16. The active loudspeaker of claim 10 wherein the DSP further comprises a digital low-pass filter connected between the second DSP channel input and the second DSP channel output.

17. The active loudspeaker of claim 16 wherein the digital low-pass filter comprises a second-order low-pass filter.

18. The active loudspeaker of claim 16 wherein the digital low-pass filter comprises a plurality of cascaded low-pass filters.

19. The active loudspeaker of claim 10 wherein the second power amplifier further comprises an analog signal booster stage.

* * * * *